US009828835B2

(12) United States Patent
Krueger et al.

(10) Patent No.: US 9,828,835 B2
(45) Date of Patent: Nov. 28, 2017

(54) EXPANSION JOINT WITH ONE WAY MOVEMENT FEATURE

(71) Applicant: Baker Hughes Incorporated, Houston, TX (US)

(72) Inventors: Matthew J. Krueger, Houston, TX (US); Sidney K. Smith, Conroe, TX (US); William J. Cauley, Houma, LA (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 84 days.

(21) Appl. No.: 13/749,085

(22) Filed: Jan. 24, 2013

(65) Prior Publication Data

US 2014/0203547 A1 Jul. 24, 2014

(51) Int. Cl.

| | |
|---|---|
| ***F16L 27/12*** | (2006.01) |
| ***E21B 43/10*** | (2006.01) |
| ***E21B 17/07*** | (2006.01) |

(52) U.S. Cl.

CPC ..... *E21B 43/10* (2013.01); *E21B 17/07* (2013.01)

(58) Field of Classification Search

CPC ..... F16L 27/12

USPC .... 285/145.1, 298, 302, 300, 303, 319, 108; 166/242.7, 242.6; 175/321, 322; 403/109.2, 109.3, 109.8

See application file for complete search history.

(56) References Cited

U.S. PATENT DOCUMENTS

| | | | | |
|---|---|---|---|---|
| 4,478,544 | A | 10/1984 | Strand | |
| 4,582,265 | A | 4/1986 | Petronelli | |
| 4,607,865 | A * | 8/1986 | Hughes | 285/18 |
| 4,754,812 | A | 7/1988 | Gentry | |
| 4,778,008 | A | 10/1988 | Gonzalez et al. | |
| 4,792,163 | A * | 12/1988 | Kulle | A61M 39/1011 108/44 |
| 4,900,066 | A * | 2/1990 | Brammer et al. | 285/92 |
| 4,989,902 | A * | 2/1991 | Putch | 285/18 |
| 5,160,172 | A * | 11/1992 | Gariepy | 285/18 |
| 5,197,546 | A | 3/1993 | Murray | |
| 5,375,670 | A * | 12/1994 | Ekwall et al. | 175/215 |
| 5,404,944 | A * | 4/1995 | Lynde et al. | 166/117.7 |
| 7,080,693 | B2 | 7/2006 | Walker et al. | |
| 7,677,303 | B2 | 3/2010 | Coronado | |
| 8,109,339 | B2 | 2/2012 | Xu | |
| 8,342,579 | B2 * | 1/2013 | Hennemann | F16L 37/088 285/319 |
| 2004/0051314 | A1 * | 3/2004 | Andre | F16L 25/009 285/319 |
| 2008/0030025 | A1 * | 2/2008 | Vogel et al. | 285/308 |
| 2010/0163250 | A1 * | 7/2010 | Schultz et al. | 166/381 |
| 2012/0049513 | A1 * | 3/2012 | Herrera | 285/331 |
| 2014/0346739 | A1 | 11/2014 | Varghese et al. | |

* cited by examiner

*Primary Examiner* — Aaron Dunwoody

(74) *Attorney, Agent, or Firm* — Steve Rosenblatt

(57) ABSTRACT

A telescoping joint is used to space out ends of a string and distribute the string weight between the tie-down locations. The joint can be compressed to reduce its length but has a locking mechanism that prevents extension under tensile loading. The seals in the joint provide a longer service life due to minimization of relative movement in the expansion joint components. The locking mechanism is preferably a ratchet system that uses a body lock ring that is enabled after breaking a shear pin.

20 Claims, 4 Drawing Sheets

EXPANSION JOINT WITH ONE WAY MOVEMENT FEATURE

FIELD OF THE INVENTION

The field of the invention is telescoping or expansion joints for use in making up strings between fixed points to get the desired spacing and more particularly where the joint can be adjusted for spacing out and then tolerates further compression but resists tensile extension forces.

BACKGROUND OF THE INVENTION

Situations arise where a string has to be run between fixed locations in a wellbore such as a seal bore in a liner and a wellhead when running a tieback string between the two locations. In some situations the wellhead load limits require a load sharing arrangement for the weight of the tieback string as between its endpoints. This issue has been solved with an expansion joint that allows the weight below to bear on the liner string while the weight above is supported from the wellhead.

FIG. 1 illustrates a series of progressively smaller strings 10, 12 and 14 that can for example be 22", 16" and 14" respectively. Hanger/packers 18 and 20 respective connect strings 10 and 12 on one hand and 12 and 14 on the other hand. The issue arises as to wellhead weight limits if a tieback string is to be supported on a lower end from string 14. The solution was to use an expansion joint 22 connected to the tieback string 26 with a seal assembly 28 extending into seal bore 24, as shown in FIG. 2. Weight is transferred at ring 30 to the liner 14 but the use of the expansion joint 22 allows the weight of the tieback string 26 above it to be carried by a wellhead that is not shown.

As noted before, the expansion joint 22 allows for proper space out at the wellhead as the joint 22 has a predetermined stroke and can be compressed for installation for support at the wellhead. Once installed and put into production or injection service there are changes in stress experienced by the tieback string principally due to thermal effects. In the past the stress issue has been addressed in several ways. One way is to allow the expansion joint the ability to elongate or shrink depending on the nature of the loading. Another feature is to provide a release feature that combines locking with movement in opposed directions but employs a collet system so the that the collet fully releases to unlock the expansion joint when a predetermined stress is reached to avoid stress failure at another location on the tieback string such as at the wellhead.

The problem with such designs as illustrated in U.S. Pat. No. 4,778,008 is that in the locked position of FIG. 1 with a gap between surfaces 34a and 24a there can be movement in opposed directions of the joint 1 that will over time wear out the stacked chevron seals 21 all without triggering a release from overstress which will result in collet 24 jumping past the stop 34.

The present invention seeks to preserve the beneficial purpose of an expansion joint for initial spacing out by providing for relative movement in a single direction so that the upper end can be accurately positioned for connection to a wellhead. The joint can thereafter shrink in length due to thermal or other loading but it is locked against getting longer. What this does is eliminate the cycling of the expansion joint that tends to wear out its seals prematurely.

Locking devices such as body lock rings have long been used to hold the set in downhole packers in a variety of designs and in a variety of applications. Some examples are U.S. Pat. Nos.: 4,582,265; 4,754,812; 4,479,544; 7,080,693; 8,109,339; 5,197,546; and 7,677,303.

Those skilled in the art will better appreciate additional aspects of the present invention which minimizes seal wear with a one way locking feature that permits the joint to compress but prevents extension of the joint by a review of the detailed description of the preferred embodiment and the associated drawings while recognizing that the full scope of the invention is to be found in the appended claims.

SUMMARY OF THE INVENTION

A telescoping joint is used to space out ends of a string and distribute the string weight between the tie-down locations. The joint can be compressed to reduce its length but has a locking mechanism that prevents extension under tensile loading. The seals in the joint provide a longer service life due to minimization of relative movement in the expansion joint components. The locking mechanism is preferably a ratchet system that uses a body lock ring that is enabled after breaking a shear pin.

DETAILED DESCRIPTION OF THE PREFERRED EMBODIMENT

Figure 1:
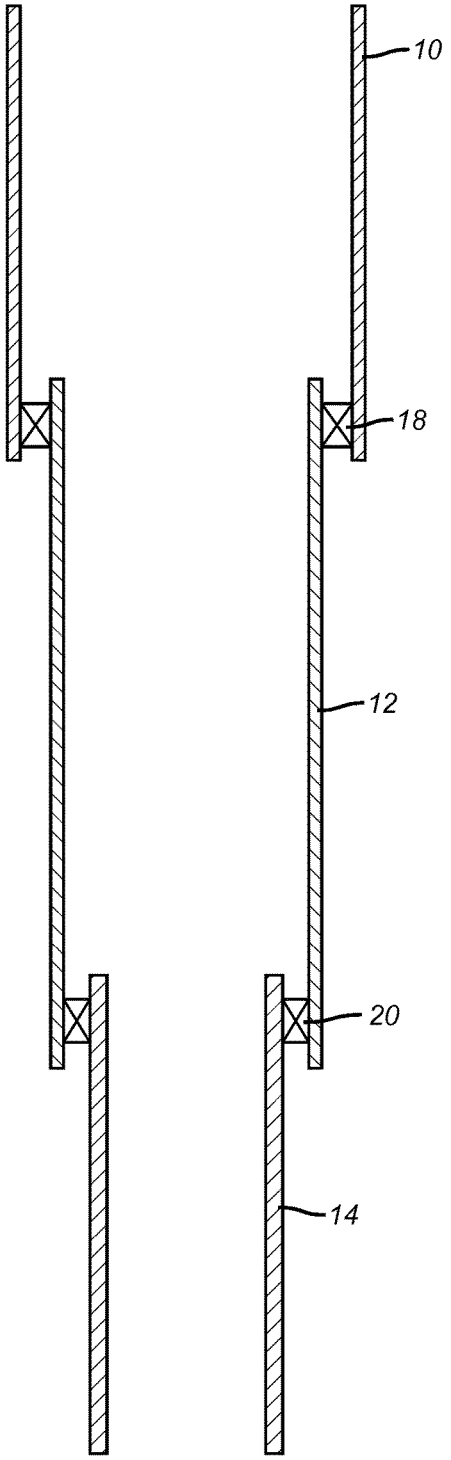
(PRIOR ART) FIG. 1
FIG. 1 is a section view of a wellbore showing a plurality of connected strings sealingly held to each other and progressively decreasing in size.
Figure 2:
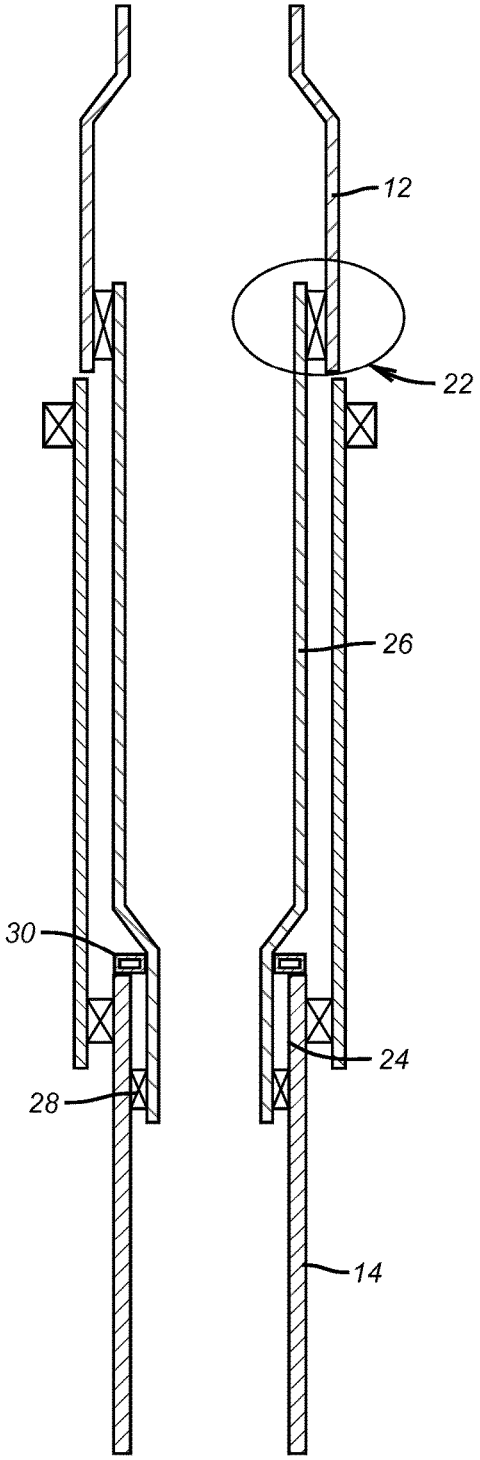
(PRIOR ART) FIG. 2
FIG. 2 shows an addition of a tieback string to FIG. land using an expansion joint for sharing load between opposed ends of the tieback string.
Figure 3:
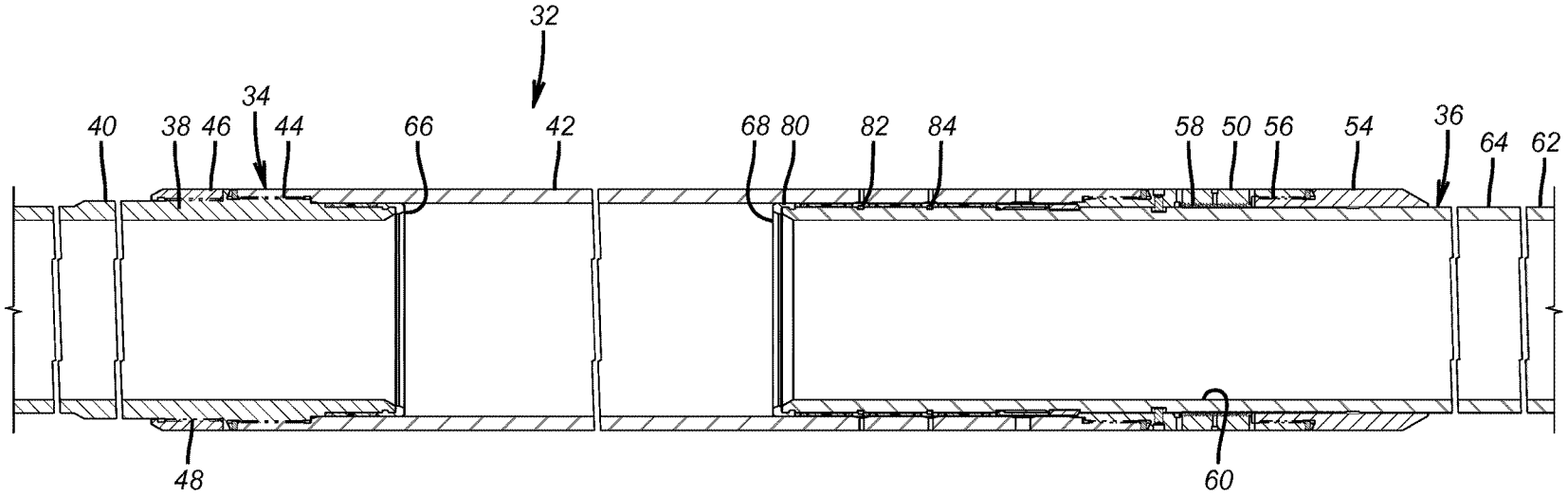
FIG. 3 is a section view of the expansion joint of the present invention in the run in position.
Figure 4:
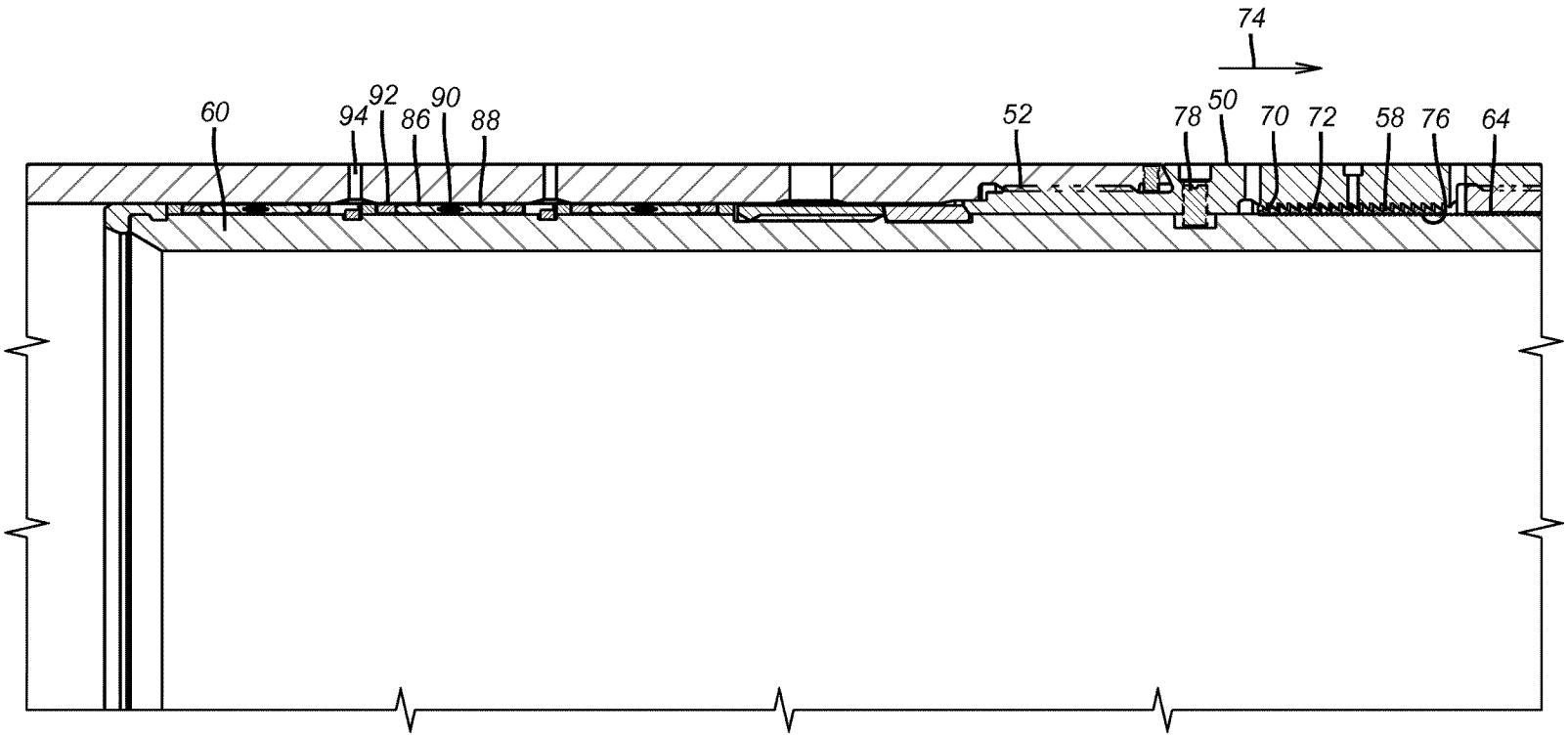
FIG. 4 is an enlarged view of a part of FIG. 3.

The expansion joint assembly 32 is shown wholly in FIG. 3 and partly in FIG. 4. Referring to FIG. 3 there is an upper outer assembly 34 and an inner lower assembly 36. The upper assembly 34 has a top sub 38 to which a string such as 26 can be attached at thread 40. Top sub 38 is attached to body or outer cylinder 42 at thread 44. An upper ring 46 can be threaded at 48 to the top sub 38. At the lower end of the outer cylinder 42 is body lock ring housing 50 attached at thread 52. Bottom sub 54 is secured to the body lock ring housing 50 at thread 56. Referring to FIG. 4 for greater detail, lock ring 58 is located within housing 50 and outside the inner body 60. A thread 62 is used to support additional tubulars and seals such as for landing in a seal bore of an existing string below in a manner known in the art.

Body 60 has an exterior ratchet pattern 64 on which the lock ring 58 can ratchet over in a direction of motion that brings lower end 66 of the top sub 38 closer to the upper end 68 of the body 60 that is stationary due to support in a seal bore below such as in a packer (not shown). Lock ring 58 has an outer ratchet pattern 72 that meshes with inner ratchet pattern 70 of the lock ring housing 50 so that movement of the housing 50 in the direction of arrow 74 will engage patterns 70 and 72 for tandem movement of housing 50 and ring 58. Ring 58 has an inner ratchet pattern 76 that permits the lock ring 58 to slide in the direction of arrow 74 over the ratchet pattern 64 but not in the reverse direction.

Initially in the extended position, shear pin or pins 78 hold the housing 50 to the inner body 60. Once the needed space out is obtained by breaking the shear pin or pins 78 and moving the outer assembly 34 in the direction of arrow 74 the lock ring 58 has its ratchet pattern 76 moved over stationary ratchet pattern 64 and the joint 32 is shortened as the string 26 is secured at its upper end to a wellhead (not shown). Once in service further movement can occur by the outer assembly 34 in the direction of arrow 74 but movement in the reverse direction is precluded as ratchet pattern 76 is not configured to move in such opposite direction over ratchet pattern 64.

Inner body 60 has an upper ring 80 and lower rings 82 and 84 spaced apart to allow one or more pairs of opposed bullet seals such as 86 and 88 with an intermediate o-ring seal 90 in between. Various spacers 92 and ports 94 to prevent liquid locking on relative movement of outer assembly 34 relative to stationary lower assembly 36 can be used. While three such assemblies are shown fewer or greater numbers can be used or other sealing systems altogether, without departing from the invention.

Figure 5:
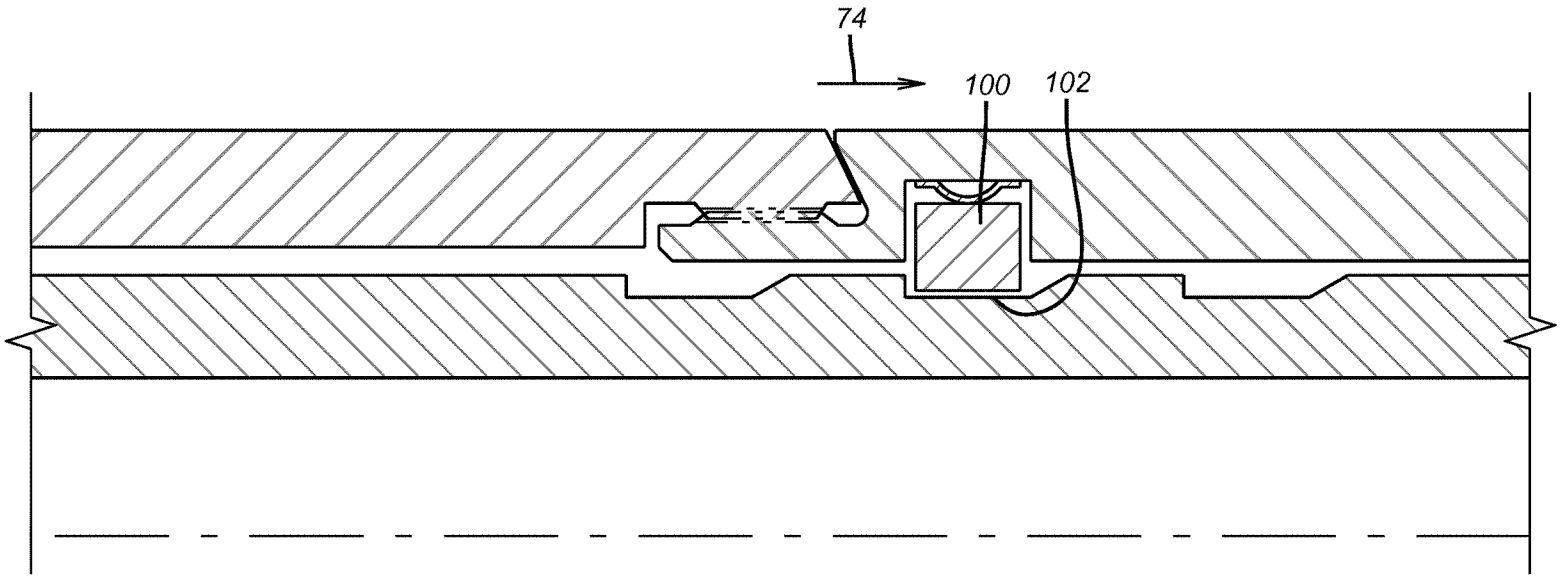
FIG. 5 is a section view of an alternative embodiment to FIG. 3.

Those skilled in the art will appreciate that the one way telescoping feature can be attained in other ways from that described above for the preferred embodiment. For example, a collet interacting with a spring-loaded sleeve in conjunction with spaced apart grooves can allow movement in increments in the direction of arrow 74 with the spring pushing the sleeve into a supporting position for the collet selectively in differing grooves in the manner of a fishing spear but with no ultimate release or extension feature. Another option shown in FIG. 5 is a shaped dog 100 that can come out of a profile 102 when the movement is in the direction of arrow 74 but whose square shape on an opposite end from a tapered shape prevents coming out of a mating profile under a tensile force applied to the joint. The limiting of the telescoping to a single direction reduces seal wear that can lead to premature failure of the joint. Clearly, without a release feature some thought has to be given to the level of the expected tensile stress to avoid an overstressing of the system in tension.

The above description is illustrative of the preferred embodiment and many modifications may be made by those skilled in the art without departing from the invention whose scope is to be determined from the literal and equivalent scope of the claims below:

We claim:

1. A subterranean telescoping assembly for a tubular sting secured at opposed ends thereof, comprising:

an outer tubular assembly axially slidably and sealingly mounted to an inner tubular assembly in an initial extended position, defined by said outer an inner tubular assemblies being secured and sealed to each other, and as a result of axial relative telescoping motion in a first direction away from said extended position into one of a plurality of spaced retracted stopping positions where said outer and inner tubular remain sealed to each other reverse relative motion of said tubular assemblies toward said initial extended position is non-releasably locked while further telescoping in said first direction is possible with said inner and outer tubulars remaining sealed to each other.

2. The assembly of claim 1, wherein:

said relative motion in said first direction brings said assemblies together.

3. The assembly of claim 1, further comprising:

a ratchet assembly disposed between said tubular assemblies.

4. The assembly of claim 3, wherein:

said ratchet assembly comprises a body lock ring.

5. The assembly of claim 4, wherein:

said body lock ring moves in tandem with said outer tubular assembly.

6. The assembly of claim 5, wherein:

said inner assembly comprises an exterior ratchet pattern on an exterior surface thereof;

said body lock ring rides over said exterior ratchet pattern in only one direction.

7. The assembly of claim 6, wherein:

said locking of said tubular assemblies prevents said tubular assemblies from moving away from each other under tensile loading.

8. The assembly of claim 7, wherein:

said inner and outer tubular assemblies are releasably retained to each other.

9. The assembly of claim 8, wherein:

said releasable retaining is accomplished with at least one shear pin.

10. The assembly of claim 9, wherein:

said shear pin is broken with a compressive force applied to said outer tubular assembly.

11. The assembly of claim 1, wherein:

said inner tubular assembly is stationary and said outer tubular assembly is movable toward said inner tubular assembly.

12. The assembly of claim 1, wherein:

said locking of said tubular assemblies prevents said tubular assemblies from moving away from each other under tensile loading.

13. The assembly of claim 1, wherein:

said inner and outer tubular assemblies are releasably retained to each other.

14. The assembly of claim 13, wherein:

said releasable retaining is accomplished with at least one shear pin.

15. The assembly of claim 14, wherein:

said shear pin is broken with a compressive force applied to said outer tubular assembly.

16. The assembly of claim 1, wherein:

said tubulars are rotationally locked for at least a portion of said axial relative motion in said first direction.

17. The assembly of claim 16, wherein:

said tubulars are rotationally locked for said axial relative motion in said first direction.

18. The assembly of claim 1, wherein:

said tubulars are not rotationally locked for said axial relative motion in said first direction.

19. A subterranean telescoping assembly for a tubular sting secured at opposed ends thereof, comprising:

an outer tubular assembly axially slidably and sealingly mounted to an inner tubular assembly in an initial extended position, defined by said outer an inner tubular assemblies being secured and sealed to each other, and as a result of axial relative telescoping motion in a first direction away from said extended position into one of a plurality of spaced retracted stopping positions reverse relative motion of said tubular assemblies toward said initial extended position is non-releasably locked;

at least one dog or collet selectively movable into a plurality of grooves.

20. The assembly of claim 19, wherein:

said grooves having a radial surface at upper ends and an opposed tapered surface at lower ends thereof;

said dog or collet having a radial surface at an upper end and an opposed tapered surface at a lower end thereof;

said dog or collet being wedged out of one of said grooves on said tapered surfaces as said upper and lower tubular assemblies move relatively toward each other while said dog or collet being trapped by contact of said radial surfaces as said upper and lower tubular assemblies are subjected to tensile force.

* * * * *